US005205413A

United States Patent [19]

Cautereels et al.

[11] Patent Number: 5,205,413

[45] Date of Patent: Apr. 27, 1993

[54] LUNCHBOX WITH REVERSIBLE COVER

[75] Inventors: Victor J. J. Cautereels, Borsbeek, Belgium; Lee E. Fether, London; Ian Ferris, Wokingham, both of United Kingdom

[73] Assignee: Dart Industries Inc., Deerfield, Ill.

[21] Appl. No.: 886,799

[22] Filed: May 21, 1992

[51] Int. Cl.[5] ..... B65D 6/28; A45C 13/26; A45C 11/20

[52] U.S. Cl. ..... 206/541; 206/549; 220/4.21; 220/4.22; 220/356; 220/324; 190/116; 190/118

[58] Field of Search ..... 220/4.21, 4.22, 4.23, 220/4.24, 4.27, 356, 324; 206/541, 549; 190/116, 118

[56] References Cited

U.S. PATENT DOCUMENTS

| | | | |
|---|---|---|---|
| 2,097,186 | 10/1937 | Hinnenkamp | 220/324 X |
| 2,606,708 | 8/1952 | Irvan | 220/356 |
| 3,266,655 | 8/1966 | Trunk | 220/4.24 |
| 3,451,580 | 6/1969 | Husby | 220/4.21 |
| 3,767,110 | 10/1973 | Congleton | 220/324 X |
| 3,937,389 | 2/1976 | Wind | 220/4.21 X |
| 4,216,862 | 8/1980 | Daenen | 220/4.21 X |
| 4,782,977 | 11/1988 | Watanabe et al. | 220/324 |
| 4,986,438 | 1/1991 | Borst | 220/324 X |

FOREIGN PATENT DOCUMENTS

| | | | |
|---|---|---|---|
| 557554 | 5/1958 | Canada | 220/4.24 |

*Primary Examiner*—William I. Price
*Attorney, Agent, or Firm*—John A. Doninger

[57] ABSTRACT

A lunchbox including a wedge-shaped tray and a similarly configured wedge shaped cover positionable thereover in reversible end to end positions to form different internal space configurations. Latch assemblies locking the cover to the tray in each position. Both latch assemblies being completely disengageable. Alternatively, one latch assembly can remain engaged to define a hinge assembly for pivotal movement of the cover.

15 Claims, 5 Drawing Sheets

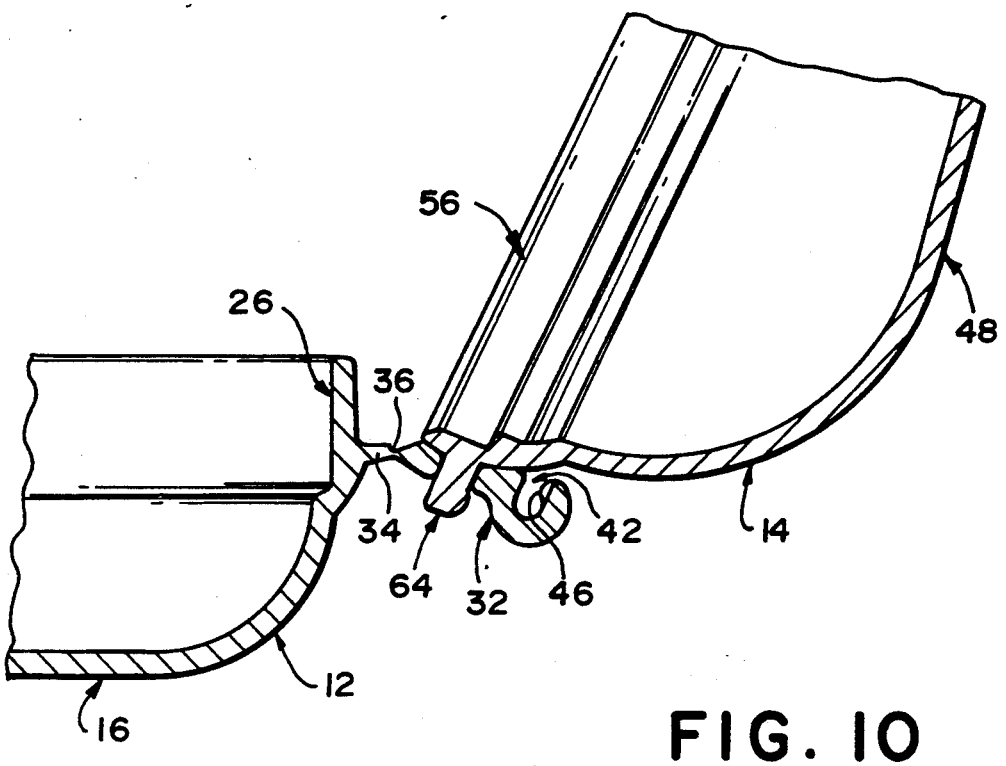
FIG. 10
FIG. 9
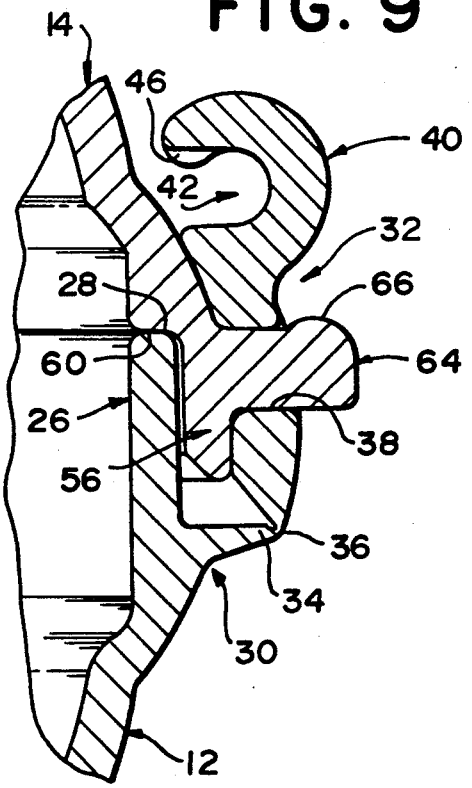
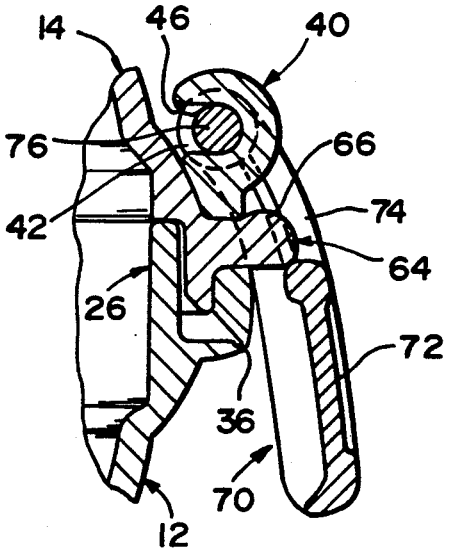
FIG. 11

LUNCHBOX WITH REVERSIBLE COVER

BACKGROUND OF THE INVENTION

Lunchboxes are universally known and used as a convenient means for the packing and carrying of food by school children, workers, hikers, or for that matter anyone wishing to have a meal available for subsequent consumption.

Conventional lunchboxes are of rather standard construction, normally a rectangular box with a hinge mounted lid releasably secured by one or more latches. Such lunchboxes, by their very nature, have a restricted interior space which inherently limits the amount and physical size of the foodstuffs which can be stored therein. Similarly, the conventional lunchbox is of a fixed size which cannot be varied to adjust to or accommodate to different foodstuffs or combinations thereof.

Other problems frequently encountered in conventional lunchboxes, arise from the use of small latches which can be difficult to both latch and unlatch, particularly by a young child, and in which many instances do not adequately secure the lid.

In addition, the conventional lunchbox is usually difficult to clean because of the sharply angled corners therein and the permanent hinge mounting of the lid or cover thereto. The permanently mounted lid also limits use of the lunchbox as a food tray from which foodstuffs, such as salads, can be directly consumed.

SUMMARY OF THE INVENTION

The lunchbox of the present invention is of highly practical and attractive construction comprising a tray and a separately formed cover.

It is a significant object of the invention to provide a lunchbox wherein, through the simple expedient of varying the orientation of the cover relative to the tray, the internal space configuration of the closed lunchbox can be changed, thus enabling an adjustment of the configuration of the lunchbox in accord with the nature of the contents to be packed therein.

Another significant object of the invention resides in the provision of a cover which, at the option of the user, can be completely separated from the tray, or retained attached to the tray by a hinge structure. The hinged connection of the cover to the tray is an attractive feature to avoid a possible misplacement of the cover, particularly by a young child. By the same token, the ability to completely remove the cover facilitates access to and use of the tray as a serving dish. Complete separation also facilitates proper cleaning of the lunchbox. For example, if constructed of an appropriate rigid synthetic resinous material such as high density polyethylene or polypropylene, the lunchbox can be easily hand-rinsed or actually cleaned in a dishwashing machine. The completely removable cover also allows for its use as a second tray, as might be desirable were the lunchbox packed with food for two persons.

The provision for different internal space configurations is achieved, in the preferred embodiment, by the formation of the tray and cover as generally identical wedge shaped halves or components, each including a high end wall, a low end wall and opposed side walls all extending from a generally planar base to a generally planar outer edge. The cover is reversible end to-end relative to the tray and, upon alignment of the low end wall of each component with the high end wall of the other, a slim rectangular lunchbox with parallel upper and lower panels or walls is provided.

Upon an end-to end reversal of the cover, and an alignment of the high ends with each other and the low ends with each other, a tapered or wedge shaped closed lunchbox is defined with the interior area adjacent the high end walls being of a substantially greater height for the accommodation of particularly bulky foodstuffs, such as oranges, apples, soda cans and the like.

The selective engagement of the cover to the tray, in both positions thereof, is achieved by duplicate hinged latches on the opposed end walls of the tray, and cooperating duplicate bars or latch keepers on the opposed end walls of the cover. The latches pivot upwardly and interlock with the cover bars in a manner which requires a positive manual manipulation for disengagement. The construction of the hinge latches are such whereby, upon a disengagement of one latch, the remaining engaged latch provides for a hinged joinder of the cover to the tray, allowing manipulation of the cover generally in the manner of a conventional hinged cover. The duplicate nature of the hinged latches allows for an unlatching of the cover from either end thereof and regardless of the particular end to-end orientation of the cover.

Basically, in packing the lunchbox, the food will be introduced into the upwardly opening tray, after which the cover will be oriented as to best cover the loaded tray with minimal excess internal space, thus reducing a tendency for the food to move within the lunchbox and maximizing temperature retention, whether cold or heat. As will be appreciated, the slim configuration with parallel top and bottom walls will be more easily accommodated within a child's bookbag, sportsman's pocket or briefcase. The larger wedge configuration will have the advantage of accommodating bulkier foods such as fruits, soda bottles or cans, and the like.

While not limited thereto, as an example of one size, the closed lunchbox can be 24 centimeters by 14.5 centimeters by 7.5 centimeters deep in the slim configuration, and 4.5 centimeters to 10 centimeters deep in the expanded configuration. Another contemplated size is 24 centimeters by 13.5 centimeters by 5.5 centimeters deep in the slim configuration, and 3.5 centimeters to 7.2 centimeters deep in the expanded configuration.

As desired, a separately formed name tag can snap-mount to one of the hinged latches for both identifying the owner of the lunchbox and acting as an enlarged hand grip for facilitating manipulation of the associated latch.

Other features, objects and advantages of the invention are considered to reside in the details of construction and manner of use of the lunchbox as will be more fully hereinafter set forth.

BRIEF DESCRIPTION OF THE DRAWINGS

FIG. 9 is a cross sectional view similar to FIG. 8 with the latch engaged;

FIG. 10 is a cross sectional view with an engaged latch assembly utilized as a hinged or pivoted mounting for the cover to the tray; and FIG. 11 is an enlarged cross sectional detail illustrating the latch mounted name tag.

DESCRIPTION OF THE PREFERRED EMBODIMENTS

Figure 1:
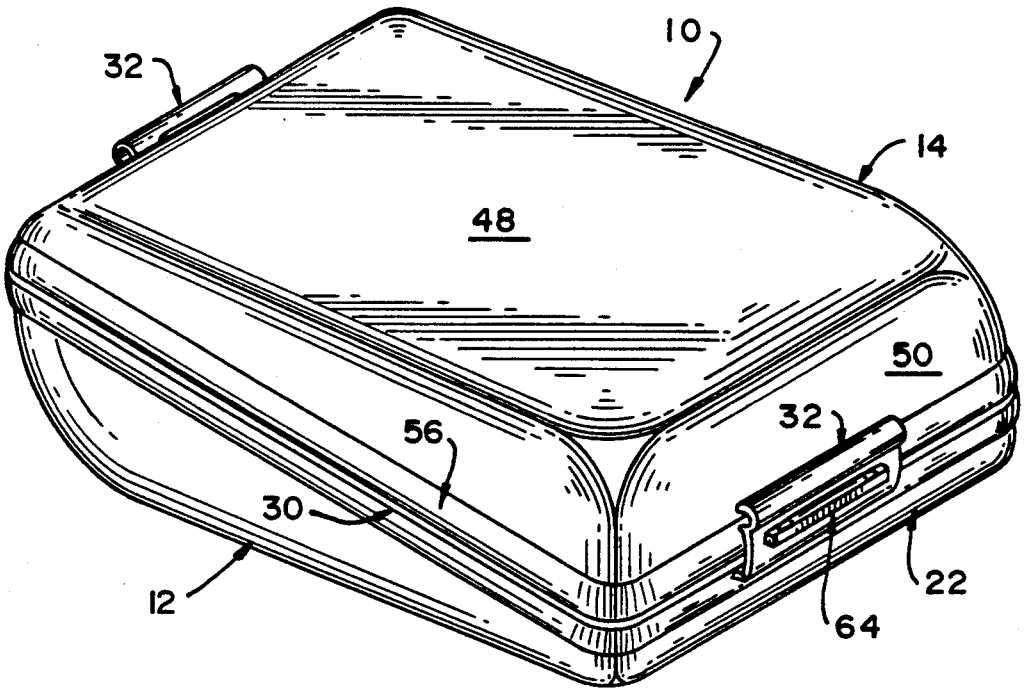
FIG. 1 is a perspective view of the lunchbox with the cover oriented to provide a slim configuration.

Referring now more specifically to the drawings, the lunchbox 10 is formed of generally similar completely separable halves or components comprising a tray 12 and a cover 14.

The tray 12 includes a planar base panel 16, preferably rectangular, which defines the bottom wall of the lunchbox. As desired, the base panel may include four depending low profile feet 18. Integrally formed high and low end walls 20 and 22 extend upwardly respectively from the opposed ends of the base panel 16 along smooth arcs and are in turn integrally joined by generally triangular side walls 24 with arcuate corners defined therebetween and between the side walls 24 and the base panel 16.

The tray walls terminate in a continuous generally flat peripheral flange 26 which defines the upper edge 28 of the tray in a plane inclined relative to the base panel 16 between the high and low end walls 20 and 22. As illustrated, the peripheral flange 26 is slightly outwardly offset from the wall portions therebelow and extends at substantial right angles to the defined plane of the upper edge 28. A support shoulder 30 is integrally formed and projects outward from the peripheral flange 26 in spaced relation to the free upper edge continuously about the tray.

The tray 12, for securement of the cover 14 thereto, includes a pair of duplicate hinged latches 32, one on each end wall. The peripheral shoulder 30, for a length thereof coextensive with each elongate latch 32, includes an integral extension or outwardly extending portion 34 terminating in a linear outer edge to which the inner edge of the corresponding latch 32 is integrally joined by a living hinge 36. The living hinge 36 will normally be an area of reduced thickness about which the hinged latch 32 can freely and repeatedly bend without deterioration of the hinge joinder itself.

Each latch 32, outward of and parallel to the hinge 136, has an elongate locking slot 38, with rounded edges, defined therethrough. Each latch 32, outwardly spaced from the slot 38, terminates in a full length enlarged arcuate or bulbous edge portion 40 having, in the open position of the latch, a full length upwardly directed pocket 42 of generally U-shaped configuration. The outer wall 44 of the pocket 42 includes integral elongate arcuate retaining lips 46 at the mouth of the pocket 42 and extending longitudinally inward from the opposed ends thereof for a minor distance of the length of the pocket. The arcuate retaining lips 46 of each pocket terminating at approximately the corresponding ends of the elongate locking slot 38.

The cover 14, while of a similar configuration to that of the tray 12, is of slightly less depth throughout the extent thereof.

The cover 14 includes a planar base panel 48, also preferably rectangular and in any event the same configuration as the base panel 16 of the tray 12. The base panel 48 defines the top wall of the lunchbox 10 and may, for purposes of decoration, include an etched pattern on the upper surface thereof.

Integrally formed high and low end walls 50 and 52 depend downwardly respectively from the opposed ends of the base panel 48 along smooth arcs. The opposed end walls 50 and 52 are in turn integrally joined by a pair of generally triangular side walls 54 with arcuate corners defined therebetween and between the side walls 54 and the top wall or base panel 48.

Figure 7:
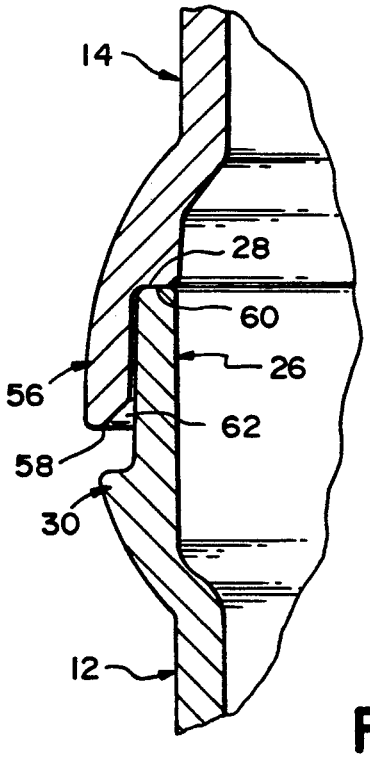
FIG. 7 is an enlarged cross sectional detail illustrating the cover and tray edge overlap at an intermediate point between the opposed latch assemblies.

The cover walls terminate in a continuous peripheral flange 56 having a generally flat inner face and defining the lower edge 58 of the cover 14. This lower edge 58 is in a plane inclined relative to the cover base panel 48 between the high and low end walls 50 and 52 thereof. Noting the cross sectional detail of FIG. 7 in particular, the cover flange 56 is slightly outwardly offset from the wall portions thereof to define a downwardly directed seat or shoulder 60. The outward offset of the cover flange 56 is such so as to receive the corresponding tray flange 26 immediately inward thereof and preferably in frictional sealing engagement therewith, the closing of the cover flange 56 over the tray flange 26 being facilitated by a slight bevelling, as at 62, of the lower edge 58 of the cover 14. As will also be noted, the height of the cover flange 56 is less than that of the tray flange 26 so as to insure a proper sealed seating of the cover shoulder 60 on the free upper edge 28 of the tray, this engagement comprising the principal seal peripherally about the tray and cover joinder. In order to provide for a smooth projection free external surface and an aesthetically pleasing appearance at the joinder between the tray and cover, both the outer face of the cover flange 56 and the outer face of the shoulder portion 30 of the tray can be slightly arcuate and only interrupted by the minor spacing between the lower cover edge 58 and the upper face of the shoulder 30.

The cover 14, for securement of the tray 12 thereto, includes a pair of duplicate locking bars 64 which define latch keepers, one integral with and projecting outward from each of the cover end walls 50 and 52. The locking bars 64 are positioned on the cover flange 56 upwardly spaced from the lower outer edge 58 thereof and are of a length slightly less than that of the hinged latch locking slots 38 for engagement therethrough as best detailed in FIG. 9. Each of the locking bars includes an upwardly projecting rounded rib or projection 66 centrally along a major portion of the length thereof. The width of each locking bar 64 is such so as to extend, with a snap lock action, through the corresponding locking slot 38 to engage therebeyond. It is contemplated that the nature of the material of the tray and cover, and in particular the hinged latch 32 and locking bar 64 be such as to enable a snap engagement and disengagement in response to a positive manual manipulation of the hinged latch. Once engaged, and noting FIG. 10, the strength of the engagement is such as to enable a pivotal movement of the cover 14 relative to the tray in the manner of a conventionally hinged cover. Such a movement will of course require a manual disengagement of the latch and bar at the opposed end of the lunchbox.

Figure 8:
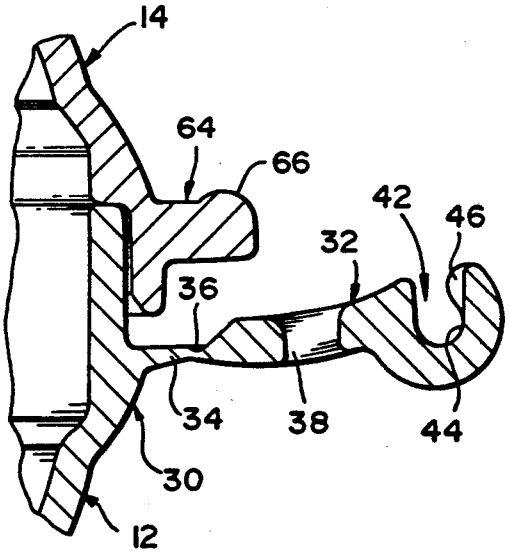
FIG. 8 is an enlarged cross-sectional detail through a latch assembly with the latch pivoted open.

Noting the detail sections of FIGS. 8 and 9, the width of the shoulder portion 30 and extension 34 thereon at each hinged latch 32 is approximately equal to the combined thicknesses of the cover flange 56, below and along the length of the corresponding locking bar 64, and the hinged latch itself inward of the locking slot 38 and adjacent the living hinge 36. Thus, in the closed position of the hinged latch 32, the hinged latch is positioned vertically and closely adjacent the outer surface of the corresponding cover wall. While the outer surface of the cover flange 56 has been described as being slightly arcuate, the portion of this outer surface immediately below each locking bar 64 can be planar to allow for a close surface to surface engagement of the corresponding upper surface of the hinged latch thereagainst.

As best seen in FIGS. 1 and 2, and 4 and 5, the cover 14 is reversible on the tray 12 end to end so as to selectively define a slim silhouette lunchbox wherein the bottom and top wall defining panels 16 and 48 parallel each other and the interior configuration of the lunchbox is of substantially equal height throughout the extent thereof. Such a space configuration is particularly adapted for sandwiches and other flat or smaller foodstuffs.

Figure 5:
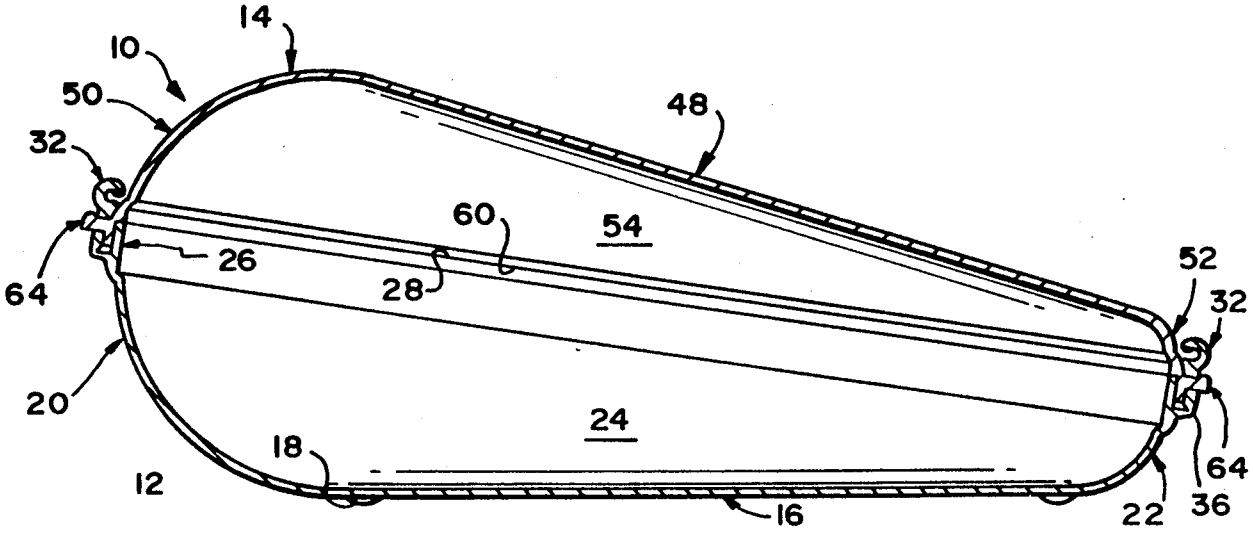
FIG. 5 is a longitudinal cross sectional view through the lunchbox as illustrated in FIG. 2 without the mounted name tag.
Figure 6:
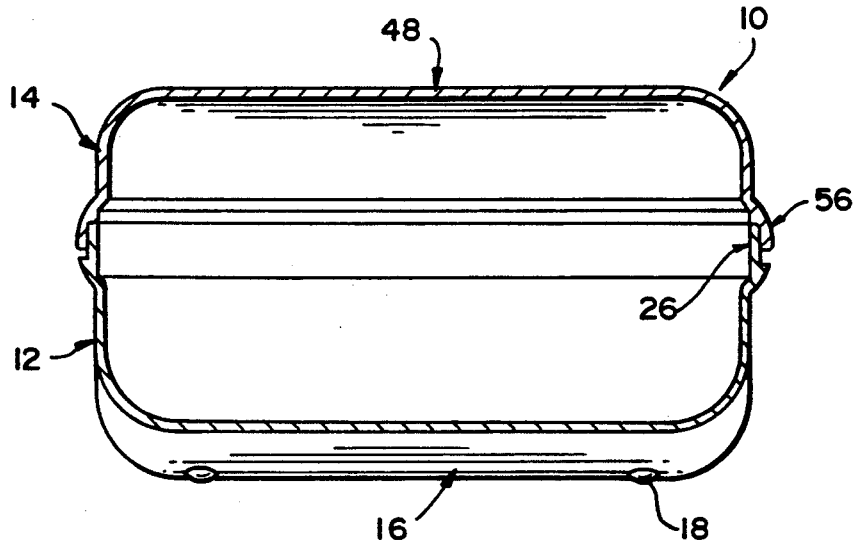
FIG. 6 is a transverse cross sectional view through the lunchbox taken substantially on a plane passing along line 6—6 in FIG. 4.

Upon a turning of the cover end to-end, a tapered or wedge shaped interior configuration is defined as will be best noted in FIG. 5. The lunchbox, so configured, includes a flat bottom and an enlarged end area capable of accommodating bulky items including foodstuffs such as oranges, apples or the like, and drink cans, small thermos bottles, and other such items. The lower end of the tapered configuration is still more than adequate to accommodate salads, sandwiches, and similar foodstuffs which can be packed generally flat. Basically, the foodstuff will be positioned as best accommodated within the tray, after which the cover will be oriented as to best conform to the tray-packed food. The ability to vary the internal space configuration is particularly significant in selectively allowing for the accommodation of bulky items without requiring the provision of a lunchbox which would provide excess unused spaced for those situations wherein foodstuffs of lesser bulk are to be accommodated.

The end-to-end reversibility of the cover 14 relative to the tray is made possible by the planar free edges of the tray and cover and the uniformity of the flanged edge portions of the walls of both components which telescopically engage regardless of the end-to end relationship between the tray and cover.

Also, and of primary significance is the provision of duplicate hinged latches 32 on the opposite ends of the tray 12 and companion duplicate locking bars 64 on the opposed ends of the cover 14 which enable a locking of the cover to the tray in either of the two positions thereof.

The bulbous end portion 40 of each hinged latch 32, upon a full seating of the latch in snap-locked engagement with the corresponding locking bar 64, has the free edge thereof spaced slightly from the adjoining end wall 50, 52 of the cover 14 so as to allow for a easy manual grasping of this end portion for an outward swinging and snap disengagement of the latch from the locking bar and a corresponding release of the cover from the tray at this end. Noting the enlarged detail of FIG. 9 in particular, the outward offset of the flange portion of the cover enhances the space in between the latch bulbous portion 40 and the cover wall for finger access. It will also be noted that the engaged latch 32 is snug between the outer surface of the cover wall and the locking bar projection or rib 66.

As previously discussed, the cover can be removed completely from the tray for any of a variety of purposes, including convenience of access to the interior of the tray, for use as a separate tray, for facilitating cleaning, or the like. Alternatively, and as suggested in FIG. 10, the cover can be retained by leaving one of the hinged latches engaged, thus providing the advantage of always having the cover immediately available, avoiding misplacement of the cover, facilitating alignment and closing of the cover, and the like, such advantages being particularly desirable when the lunchbox is to be used by young children.

Figure 2:
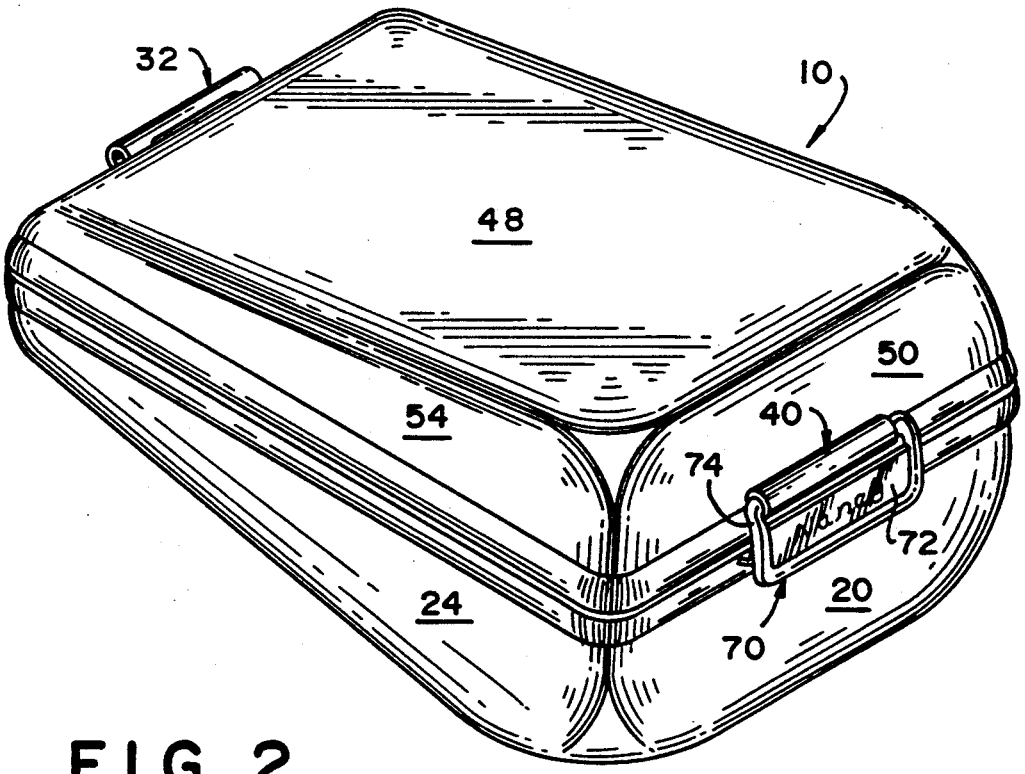
FIG. 2 is a perspective view of the lunchbox with the cover rotated end to end to provide a wedge-shaped configuration.
Figure 3:
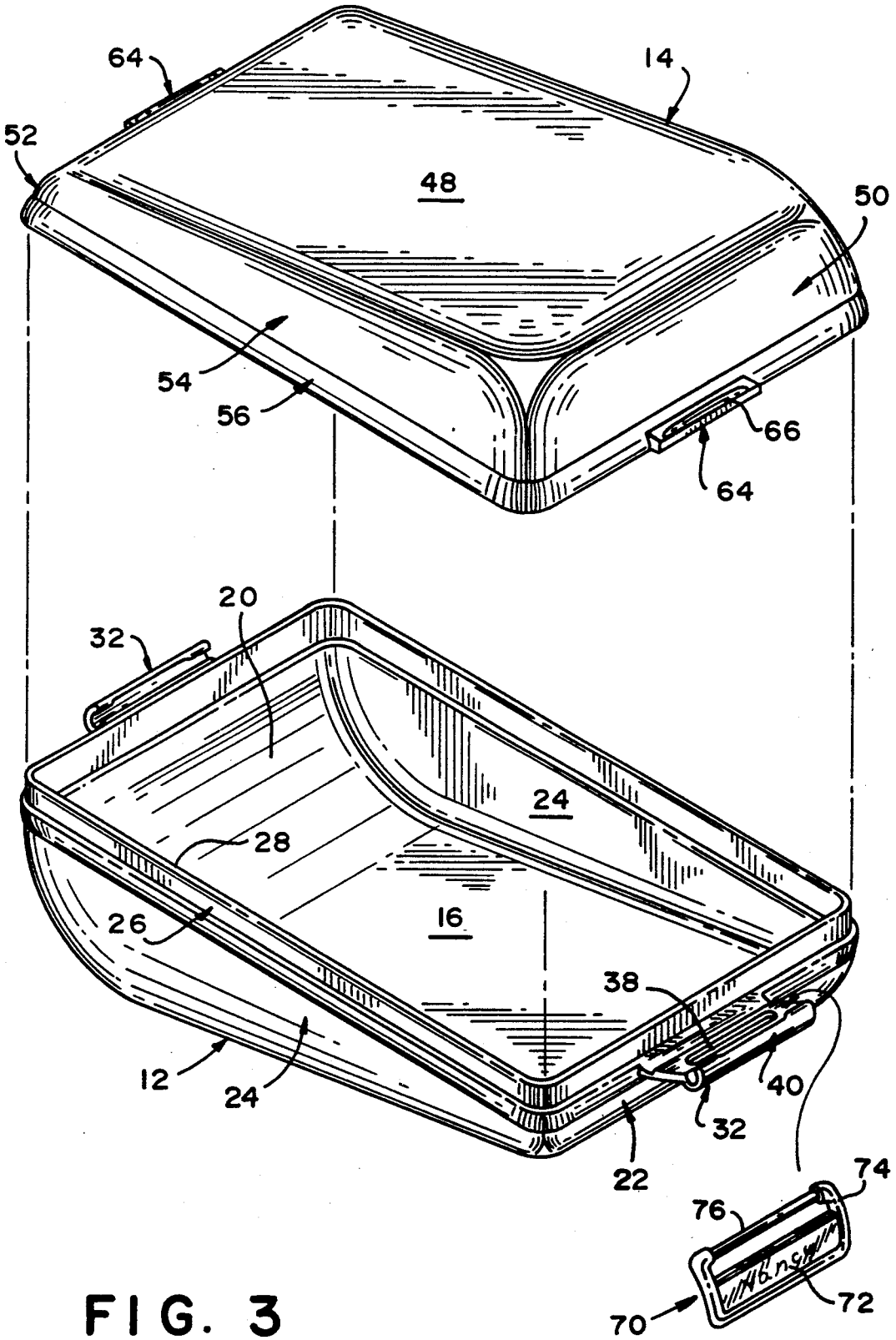
FIG. 3 is an exploded perspective view of the tray, cover and name tag of the lunchbox.
Figure 4:
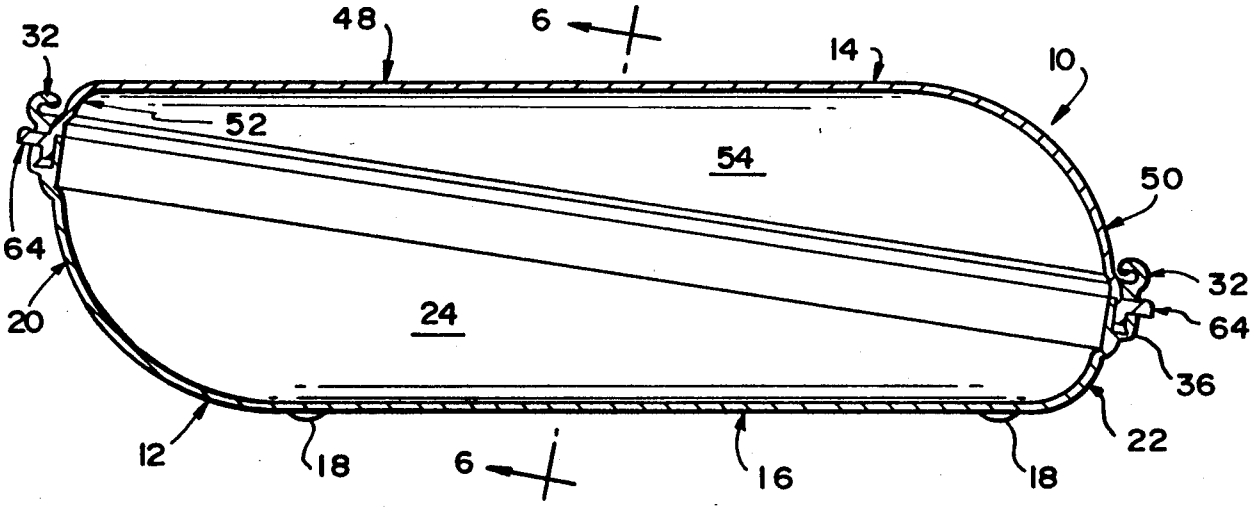
FIG. 4 is a longitudinal cross sectional view through the lunchbox as illustrated in FIG. 1.

Noting FIGS. 2, 3 and 11, the invention also contemplates provision of a name tag accessory 70. The accessory 70 is of a length slightly greater than that of a hinged latch 32, and includes a generally planar panel 72 on which a name can be printed or to which a printed name can be affixed in any appropriate manner. Integral slightly arcuate side arms 74 are provided at the opposed ends of the panel 72 and project upwardly therefrom with the upper ends of the arms 74 interconnected by a transversely extending cylindrical mounting rod 76.

The mounting rod 76 releasably snap locks into engagement within a hinged latch pocket 42 behind the arcuate retaining lips 46 with the tag 70 depending therefrom in overlying relationship to the latched joinder. The name tag 70, with the panel 72 slightly below the corresponding locking bar 64, is positioned generally vertically to minimize the extension thereof beyond the end of the lunchbox.

As will be best appreciated from FIG. 11, the mounting rod 76 is rotatable within the pocket 42, and the tag 70 can itself function as a convenient and readily accessible handle for manipulation of the latch 32. Basically, one need merely grasp the enlarged lower plate or plate portion 72, upwardly pivot the tag and outwardly pull the tag to outwardly move and disengage the latch 32 from the locking bar 64.

The foregoing is considered illustrative of the principles of the invention. However, as variations or modifications may occur to those skilled in the art, it is not desired to limit the invention to the specific embodiment illustrated. Rather, the invention is only to be limited by the scope of the claims following hereinafter.

We claim:

1. A lunchbox comprising a tray and a separate cover, said cover being positionable over and engaged with said tray selectively in any one of a plurality of positions, said cover defining with said tray a different internal space configuration in each of said positions for the accommodation of goods and the adaptation of the internal space configuration to the shape of the goods to be accommodated, and latch means for releasably securing said cover to said tray selectively in each of said positions.

2. The lunchbox of claim 1 wherein said tray and said cover each include a base panel, a high end wall, an opposite low end wall, and opposed side walls joined to and extending between said high and low end walls to define a continuous periphery therewith, said end and side walls of each of said tray and cover projecting from the corresponding base panel and terminating in a continuous edge flange portion with an outer edge defining a plane, said plurality of positions comprising a first position wherein said high end walls are aligned and a second position wherein said cover is turned end to end and each high end wall is aligned with a low end wall, said edge flange portion of said cover being coextensive with and engaging said edge flange portion of said tray in each of said first and second positions.

3. The lunchbox of claim 2 wherein each of said tray and said cover is of a generally wedge shaped configuration, said base panels of said tray and said cover in said second position generally paralleling each other, said base panel of said cover extending at an angle to said base panel of said tray in said first position.

4. The lunchbox of claim 3 wherein said latch means includes a pair of latches, one joined to each end wall of one of said tray and said cover by a hinge, and a pair of keepers, one on each end wall of the other of said tray and said cover, both said latches being releasably engageable with both said keepers in each of said positions, said cover, upon an engagement of one latch with a corresponding keeper, being secured to said tray for pivotal movement about the hinge joining said one latch between a closed portion overlying said tray and an open position.

5. The lunchbox of claim 4 wherein each latch has an elongate slot defined therethrough, each keeper comprising an elongate bar which, upon releasable engagement of a latch and keeper, engages through a latch slot and is releasably retained therein.

6. The lunchbox of claim 5 wherein each latch includes an enlarged outer edge parallel to the associated hinge, a name tag, and means releasably mounting said name tag to one of said latch outer edges.

7. The lunchbox of claim 6 wherein said means mounting said name tag comprises an open-ended pocket defined in each outer latch edge, and an elongate mounting rod on said name tag snap-engaging within one of said pockets for retention therein, said mounting rod being rotatable within said pocket receiving said rod.

8. The lunchbox of claim 3 wherein said base panels are generally rectangular, said end and side walls joining the corresponding base panels along arcing portions.

9. The lunchbox of claim 2 wherein said latch means includes a pair of latches, one joined to each end wall of one of said tray and said cover by a hinge, and a pair of keepers, one on each end wall of the other of said tray and said cover, both said latches being releasably engageable with both said keepers in each of said positions, said cover, upon an engagement of one latch with a corresponding keeper, being secured to said tray for pivotal movement about the hinge joining said one latch between a closed portion overlying said tray and an open position.

10. The lunchbox of claim 1 wherein each of said tray and said cover comprises a base panel and peripheral wall means including opposed walls, said latch means comprising a pair of latches and a pair of keepers, one of said pairs joined with and extending from said opposed walls of said tray, the other pair being joined with and extending from the corresponding opposed walls of said cover, hinge means joining each latch to the corresponding wall, each of said latches being releasably engageable with a corresponding keeper, said cover, upon an engagement of a single latch with a corresponding keeper, being secured to said tray for pivotal movement about the hinge joining said single latch between a closed position overlying said tray and an open position.

11. The lunchbox of claim 10 wherein each latch has an elongate slot defined therethrough, each keeper comprising an elongate bar which, upon releasable engagement of a latch and keeper, engages through a latch slot and is releasably retained therein.

12. The lunchbox of claim 11 wherein each latch includes an enlarged outer edge parallel to the associated hinge, a name tag, and means releasably mounting said name tag to one of said latch outer edges for pivotal movement relative thereto, said name tag extending outward of the associated latch and defining handle means for this latch.

13. A lunchbox comprising a tray and a separate cover, said cover being positionable over and engaging with said tray to define an internal space for foodstuffs and the like, each of said tray and said cover comprising a base panel, opposed end walls and opposed side walls, latch means includes a pair of duplicate latches, a hinge joining one of said latches to each end wall of one of said tray and said cover, and a pair of duplicate keepers, one on each end wall of the other of said tray and said cover, both said latches being releasably engageable with both said keepers, said cover, upon an engagement of only one latch with a corresponding keeper, being secured to said tray for pivotal movement about the hinge joining said one latch between a closed portion overlying said tray and an open position.

14. The lunchbox of claim 13 wherein said opposed end walls of each of said tray and said cover comprise a high end wall and an opposed low end wall, said cover being selectively positionable relative to said tray between a first position wherein said high end walls are aligned and said low end walls are aligned, and a second position wherein each high end wall is aligned with a low end wall, said latches and keepers releasably engaging in both of said positions.

15. The lunchbox of claim 14 wherein each of said tray and said cover are of a generally wedge-shaped configuration, said base panels of said tray and said cover in said second position generally paralleling each other, said base panel of said cover, in said first position, extending at an angle to said base panel of said tray.

* * * * *